United States Patent [19]

Taguchi et al.

[11] Patent Number: 4,637,802

[45] Date of Patent: Jan. 20, 1987

[54] TWIN OUTBOARD DRIVE FOR WATERCRAFT

[75] Inventors: Michihiro Taguchi; Akihiro Onoue, both of Hamamatsu, Japan

[73] Assignee: Sanshin Kogyo Kabushiki Kaisha, Shizuoka, Japan

[21] Appl. No.: 823,593

[22] Filed: Jan. 29, 1986

[30] Foreign Application Priority Data

Jan. 31, 1985 [JP] Japan ..... 60-15413

[51] Int. Cl.[4] ..... B63H 21/28

[52] U.S. Cl. ..... 440/75; 440/79; 440/86; 74/378; 192/48.91

[58] Field of Search ..... 440/49, 75, 80, 84, 440/86, 900, 53, 79; 74/378, 480 B, 491, DIG. 8; 192/21, 48.91

[56] References Cited

U.S. PATENT DOCUMENTS

| | | | |
|---|---|---|---|
| 2,618,235 | 11/1952 | Clark | 440/86 |
| 2,702,615 | 2/1955 | Morse | 440/86 |
| 3,113,549 | 12/1963 | Frank | 440/86 |
| 4,228,760 | 10/1980 | Kulishenko | 440/86 |
| 4,302,196 | 11/1981 | Blanchard | 440/86 |
| 4,310,320 | 1/1982 | Pitchford | 440/79 |
| 4,527,441 | 7/1985 | Nakahama | 74/378 |

FOREIGN PATENT DOCUMENTS

| | | | |
|---|---|---|---|
| 185395 | 10/1983 | Japan | 440/86 |

*Primary Examiner*—Trygve M. Blix
*Assistant Examiner*—Stephen P. Avila
*Attorney, Agent, or Firm*—Ernest A. Beutler

[57] ABSTRACT

A twin outboard drive and more particularly to an improved transmission and shifting arrangement for such drives. The drives include forward, neutral and reverse transmissions of the bevel gear type and which provide counter-rotation of the respective associated propellers. One of the transmissions is shifted in one direction to shift from neutral to forward while the other transmission is shifted in the opposite direction to shift from neutral to forward. A pair of remote control shift levers are provided and a motion transmitting means connects the shift levers with the transmissions so that the transmissions are shifted in opposite directions when the shift levers are moved in the same direction. In some embodiments, this is accomplished by a crank and follower mechanism and in other embodiments, it is accomplished by a cam and follower arrangement.

26 Claims, 15 Drawing Figures

TWIN OUTBOARD DRIVE FOR WATERCRAFT

BACKGROUND OF THE INVENTION

This invention relates to a twin outboard drive for watercraft and more particularly to an improved transmission and shifting arrangement for such drives.

In many marine drives, particularly those associated with larger watercraft, there are employed a pair of outboard drives for powering the watercraft. These outboard drives, be they outboard motors or the outboard drive of an inboard/outboard arrangement normally employ a relatively conventional forward, neutral, reverse transmission made up of a driving bevel gear that drives a pair of oppositely rotating bevel gears that are rotatably supported on the propeller shaft. A dog clutching arrangement is associated with the transmission for selectively coupling one of the oppositely rotating bevel gears to the propeller shaft for controlling its direction of rotation. When twin outboard drives are employed, it is the normal practice to provide a separate control for each outboard drive and particularly for the transmission of the individual outboard drives.

When twin drives are employed, it is the normal practice to have the propeller shafts rotate in opposite directions when both outboard drives are operating in either the forward or reverse mode so as to improve directional stability. When this is done and when a conventional arrangement is employed wherein the input shafts rotate in the same direction, the dog clutches of the transmissions must be shifted in opposite directions to select the same transmission ratios (either forward or reverse). If conventional controls for the transmission are emloyed, this means that the operator must shift one transmission control one direction and the other transmission control in the opposite direction when he desires to operate both drives in the same direction. This obviously is confusing and can cause numerous problems.

It is, therefore, a principal object of this invention to provide an improved transmission control for outboard drives.

It is another object of this invention to provide an improved transmission control for twin outboard drives wherein the controls are movable in the same direction so as to shift the respective outboard drives into the same driving gear.

SUMMARY OF THE INVENTION

This invention is adapted to be embodied in a twin outboard drive for a watercraft that comprises a first marine drive having a first transmission provided with a forward, a neutral and a reverse drive ratio and a second marine drive which has a second transmission which is also provided with a forward, a neutral and a reverse drive ratio. A first shift element is movable between a forward, a neutral and a reverse position for operating the first transmission in those respective ratios. Similarly, a second shift element is provided that is movable between a forward, a neutral and a reverse position for operating the second transmission in those respective ratios. The first and second shift elements are movable in like directions with the forward position of the first shift element corresponding to the reverse position of the second shift element and vice versa. A first shift control is movable between a forward, a neutral and a reverse position and a second shift control is movable between a forward, a neutral and a reverse shift position. The first and second shift controls are movable between their positions in like directions. In accordance with the invention, motion transmission means operatively connect the first shift control with the first shift element and the second shift control with the second shift element for operating the respective shift elements from the respective shift controls. The motion transmitting means is constructed and arranged for providing that the movement of the first and second shift controls in the same direction from their forward position to their reverse position effect opposite movement of the shift elements so that movement of the first and second shift controls in the same direction will effect movement of the shift elements to the same drive ratios.

DETAILED DESCRIPTION OF THE PREFERRED EMBODIMENTS

Embodiment Of FIGS. 1 Through 7

Figure 1:
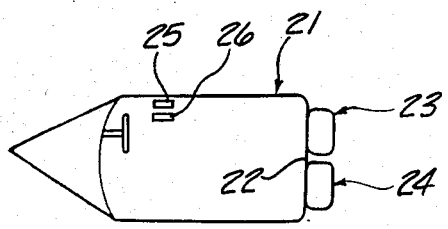
FIG. 1 is a top plan view of a watercraft powered by a twin outboard drive constructed in accordance with a first embodiment of the invention.

Referring first to FIG. 1, a watercraft adapted to be powered by a twin outboard drive constructed in accordance with an embodiment of the invention is identified generally by the reference numeral 21. The watercraft 21 includes a transom 22 to which first and second outboard drives, indicated generally by the reference numerals 23 and 24, are supported. As is well known, the outboard drives 23 and 24 are supported for steering movement about respective generally vertically extending axes and for tilting and trim movement about horizontally extending axes. The outboard drives 23 and 24 may comprise either outboard motors, as in the illustrated embodiments or the outboard drive portion of an inboard/outboard driving arrangement.

Each outboard drive 23 and 24 includes a forward, neutral and reverse transmission (to be described). Each transmission is selectively controlled by a respective controller 25 and 26 whch is adapted to shift the transmissions associated with the outboard drives 23 and 24 between their forward, neutral and reverse positions, in a manner which will now be described by particular reference to the remaining figures of this embodiment.

Figure 2:
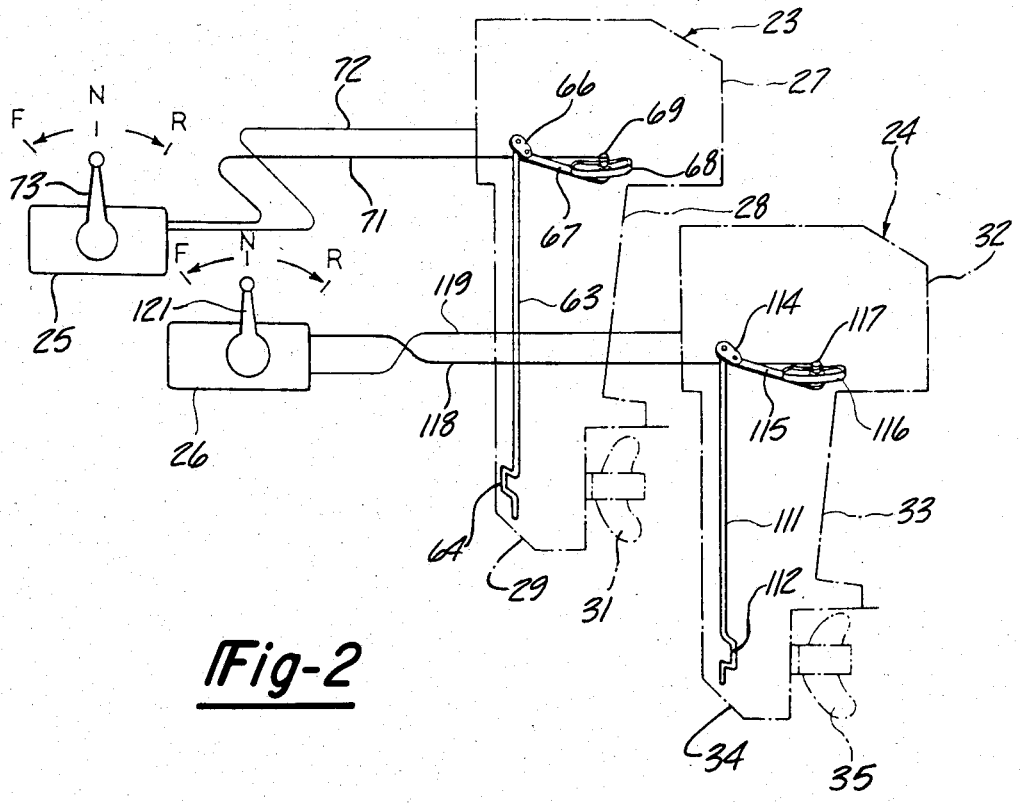
FIG. 2 is a partially schematic side elevational view of the outboard drive, on a larger scale.

Referring first additionally to FIG. 2, the outboard motor 23 is comprised of a power head 27 that contains a powering internal combustion engine and a surrounding protective cowling. The engine within the power head 27 drives a drive shaft (to be described) that is journaled for rotation about a vertically extending axis and which passes through a drive shaft housing 28. A lower unit 29 is supported at the lower end of the drive shaft housing 28 and contains a forward, neutral, reverse transmission (to be described) for selectively driving a propeller 31 in either of forward or reverse directions. In addition, the transmission provides a neutral condition in which the propeller 31 is not driven.

In a similar manner, the outboard motor 24 includes a power head 32, drive shaft housing 33, lower unit 34 and propeller 35 which are generally of the same construction as the outboard motor 23. Unless differences between the outboard motors 23 and 24 are described, it is to be assumed that they are identical in construction.

The transmission associated with the outboard motor 23 will be described by particular reference to FIGS. 3 and 6. As has been noted, the outboard motor 23 includes a drive shaft which is driven by its engine and which is identified by the reference numeral 36 in FIG. 6. Affixed to the lower end of the drive shaft 36 is a bevel driving gear 37 which rotates with the drive shaft 36. The drive gear 37 is in mesh with a pair of driven gears 38 and 39 that are disposed on diametrically opposite sides of the drive gear 37 so that rotation of the drive gear 37 will effect rotation of the driven gears 38 and 39 in an opposite senses. Each of the driven gears 38 and 39 is rotatably journaled on a propeller shaft 41 in a manner to be described.

The propeller shaft 41 is, in turn, journaled within a bearing carrier 42 that is fixed within the lower unit 39 by means including an externally threaded retainer nut 43. The propeller shaft 41 is journaled in part by means of an anti-friction bearing 44 which is of the needle type and which is carried at the rear end of the bearing carrier 42. The propeller 31 is affixed for rotation with the propeller shaft 41 in a known manner by means including a shock absorbing coupling 45 of any known type.

The driven gear 39 is rotatably journaled by means of a ball bearing 46 that is carried at the forward end of the bearing carrier 42. The propeller shaft 41 passes through and is journaled by the driven gear 39. Since the driven gear 39 in connection with the outboard motor 23 is the reverse gear, a plain bearing arrangement is provided between the gear 39 and the propeller shaft 41.

The driven gear 38, which comprises the forward drive gear, is rotatably journaled in the lower unit 29 by means of a tapered roller type thrust bearing 47. In turn, the driven gear 38 rotatably journals the forward end of the propeller shaft 41 by means of a pair of needle bearings 48.

Either of the driven gears 38 and 39 is selectively coupled for rotation with the propeller shaft 41 by means of a dog clutch which includes a clutching sleeve 49 that is axially movable along a splined connection with the outer periphery of the propeller shaft 41. The dog clutching sleeve 49 has oppositely facing dog clutching teeth 51 and 52 that are adpated to selectively cooperate with respective dog clutching teeth 53 or 54 formed on the driven gears 38 and 39, respectively.

A pin 55 extends diametrically through the dog clutching sleeve 49 and is held in place by means of a torsional spring 56 that is received in a circumferential recess 57 of the sleeve 49. The pin 55 extends through an elongated slot formed in the propeller shaft 41 so as to accommodate its axial movement relative to the propeller shaft 41 but so as to insure that the pin 55 and sleeve 49 rotate simultaneously with the propeller shaft 41. Of course, the rotational forces between the sleeve 49 and the propeller shaft 41 are transmitted through the splined connection between these elements.

The pin 55 and, accordingly, the clutching sleeve 49 is moved axially by means of a shifting sleeve 58 that is slidably supported within a bore formed at the forward end 59 of the propeller shaft 41. The pin 55 is staked to the sleeve 58 by passing through a pair of aligned cylindrical bores in the sleeve 58. The shifting sleeve 58 is affixed for axial movement with a shifting cam 61 that is supported for reciprocation within the lower unit 29 by means of a tongue and groove connection 62. The tongue and groove connection 62 permits rotation of the sleeve 58 relative to the cam 61 but couples the cam 61 and sleeve 58 together for simultaneous reciprocation.

A shifting rod 63 is rotatably journaled within the drive shaft housing 28 and lower unit 29 and has a crank shaped portion 64 that is received within a transversely extending slot 65 formed in the shifting cam 61. As should be readily apparent from FIG. 3, rotation of the shifting rod 63 will effect axial movement of the shifting cam 61 because of the crank shaped portion 64. As shown in this figure, the shifting rod 63 and its crank shaped portion 64 are rotatable between a forward, neutral and reverse position about an axis that is defined by the axis of rotation of the shifting rod 63. A detent mechanism shown in FIG. 6 and more fully shown in copending Application Ser. No. 503,570, filed June 13, 1983, entitled "Detent Mechanism For Clutches", and assigned to the assignee of this application, is provided for holding the transmission in the neutral condition and for assisting in the shifting of the transmission into the forward and reverse conditions as described in that copending application.

As may be seen in FIG. 2, a link 66 is rigidly affixed to the upper end of the shift rod 63 and is, in turn, connected to a shifting lever 67 that is formed with a cam groove 68 at its outer end. An actuator 69 is received within the cam groove 68 and is axially moved by means of a pair of wire transmitters 71 and 72 which are, in turn, controlled by a control shift lever 73 of the shift control 25.

Figure 3:
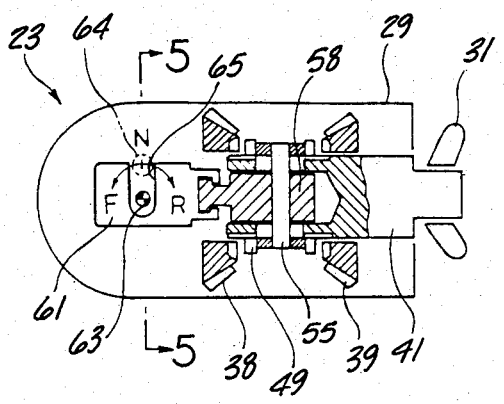
FIG. 3 is a cross-sectional view showing the transmission of one of the outboard drives.

When the lower 73 is pivoted from its neutral position in a forward direction F, the actuator 69 will traverse the groove 68 so as to rotate the shifting rod 63 in a counterclockwise direction as viewed in FIG. 3 so as to move the cam 61 and shifting sleeve 58 in a forward direction. The causes the dog clutching teeth 53 of the driven gear 38 to be engaged by the dog clutching teeth 51 of the dog clutching sleeve 49 to rotatably couple the gear 38 to the propeller shaft 41.

When the shift control lever 73 is moved rearwardly from its neutral position, the shifting rod 63 will be rotated in a clockwise direction as viewed in FIG. 3 and the cam 61 and dog clutching sleeve 49 will be moved rearwardly so that the dog clutching teeth 52 engage the dog clutching teeth 54 and rotatably couple the driven gear 39 to the propeller shaft 41 so as to drive the propeller 31 in the opposite direction.

The transmission associated with the outboard motor 24 will now be described by particular reference to FIGS. 4 and 7. It should be noted that the transmission mechanism is generally similar to that associated with the outboard motor 23 as is the general operation of the shift mechanism. Therefore, in connection with the discussion of this transmission mechanism, if any component is not described in detail, it may be assumed that this component is the same as the components of the transmission associated with the outboard motor 23.

The internal combustion engine associated with the power head 32 drives a drive shaft 74 that extends through and is journaled within the drive shaft housing 33 and the lower unit 34. A driving bevel gear 75 is affixed for rotatin with the lower end of the drive shaft 74. The driving bevel gear 75 is in mesh with a pair of driven bevel gears 76 and 77 that are disposed on opposite diametral sides of the driving bevel gear 75 so that the driven bevel gears 76 and 77 will be rotated in opposite directions upon rotation of the driving bevel gear 75. The driving and driven bevel gears are rotatably journaled upon an intermediate shaft 78 in a manner to be described and are adapted to be selectively coupled to this intermediate shaft 78 for selectively driving it in forward or reverse directions.

The driven bevel gear 76 has a hub portion that is journaled by a tapered roller type thrust bearing 79 that is, in turn, carried by an forward end of a bearing carrier 81. The bearing carrier 81 is affixed within the lower unit 33 by means including a retaining nut 82. Driven bevel gear 76 also rotatably supports the rear end of the intermediate shaft 78 by means of a needle type bearing 83.

The driven bevel gear 77 is rotatably journaled within the lower unit 33 by means of a roller type bearing 84. In turn, the driven bevel gear 77 rotatably journals the forward end of the intermediate shaft 78 by means of a pair of needle bearings 85.

The rear end of the intermediate shaft 78 is formed with external splines 86 that are received within internal splines 87 formed on the forward end of a propeller shaft 88. Thus, the propeller shaft 88 is rotatably coupled to the intermediate shaft 78 by the splined connection 86, 87.

The propeller shaft 88 is journaled within the bearing carrier 81 by means of a rear anti-friction needle bearing 89 and a front anti-friction needle bearing 91. In addition, the propeller shaft 88 is provided with annular flange 92 that serves as a thrust flange. A rear face 93 of the flange 92 engages a thrust bearing 94 that is contained between the bearing carrier 81 and the thrust flange 92. The thrust bearing 94 takes reverse driving thrusts which are generally smaller than forward driving thrusts. The flange 92 also has a forward face 95 that is engaged with the inner race of the thrust bearing 79. The thrust bearing 79 is held in place by means of an annular thrust member 96 that is affixed to the lower unit 33 and is axially held in position by the bearing carrier 81 and nut 82. Hence, forward driving thrusts are transmitted to the thrust bearing 79 and lower unit 33 so as to absorb these larger driving thrusts.

The rear end of the propeller shaft 88 extends beyond the lower unit 33 and is rotatably coupled to the propeller 35 by means including a thrust absorbing coupling 97.

A dog clutching sleeve 98 is non-rotatably but axially slidable on the intermediate shaft 78 by means of a splined connection. The sleeve 97 has oppositely facing dog clutching teeth 99 and 101 that are adapted to coact with respective dog clutching teeth 102 and 103 formed on the driven bevel gears 76 and 77, respectively. When the dog clutching teeth 99 and 102 are in engagement, the driven gear 76 will be rotatably coupled to the intermediate shaft 78 and propeller shaft 88 for driving the propeller 35 in a forward direction. When the dog clutching teeth 101 and 103 are in engagement, the driven bevel gear 77 will be coupled to the intermediate shaft 78 and propeller shaft 88 for driving the propeller 35 in a reverse direction.

Axial movement of the dog clutching sleeve 98 is achieved by means that includes a pin 104 that is affixed to the sleeve 98 and which is held in position by means of a torsional spring 105 that is received within a circumferential groove 106 of the sleeve 98. The pin 104 is axially movable within a pair of diametrically opposed slots formed in the intermediate shaft 78.

A shifting sleeve 107 is received within a bore formed in the intermediate shaft 78 and has a pair of aligned bores that axially affix the shifting sleeve 107 to the pin 104 and, accordingly, to the dog clutching sleeve 98.

The shifting sleeve 107 has a tongue and grove connection 108 to a shifting cam 109 that is reciprocally supported in a bore in the lower unit housing 33. The connecting tongue and groove connection permits rotation of the sleeve 107 relative to the cam 109 but affixes these two elements together for simultaneous axial movement.

A shifting rod 111 extends vertically through the drive shaft housing 33 and lower unit 34 and has a crank shaped portion 112 that is received within a slot 113 of the cam 109 for axially moving it upon rotation of the shifting rod 111.

Referring now to FIG. 2, a link 114 is rigidly affixed to the upper end of the shift rod 111. A lever 115 carrying a cam groove 116 is connected to the link 114. An actuating member 117 is received within the groove 114 and is axially moved by means of a pair of wire transmitters 118 and 119 that are controlled by a control lever 121 of the control mechanism 26.

Because of the use of the twin outboard drives 23 and 24, they should normally rotate in opposite directions so as to achieve a driving thrust in the same direction.

To achieve this while to permit the internal combustion engines associated with the power heads 27 and 32 to rotate in the same direction, the gear 38 of the transmission associated with the outboard motor 23 constitutes the forward drive gear while the corresponding position gear 77 of the transmission associated with the outboard motor 32 comprises the reverse drive gear. In a similar manner, the gear 39 of the transmission of the outboard motor 23 to the rear of the driving bevel gear 37 comprises the reverse gear while the the corresponding gear 76 of the transmission associated with the outboard motor 24 comprises the forward drive gear. Hence, it should be readily apparent that the shifting sleeve 38 and dog clutching element 49 of the outboard motor 23 must be moved forwardly to achieve forward drive while the corresponding shifting sleeve 107 and dog clutching element 98 associated with the outboard motor 24 must be shifted rearwardly to accomplish foward drive.

Thus, with conventional mechanisms, it would be necessary to move the lever 73 of the controller 25 in a forward direction and the lever 121 of the conrtroller 26 in a rearward direction so as to shift both outboard motors 23 and 24 into forward drive. Reverse drive would require movement of the levers 73 and 121 in the opposite directions. Such an arrangement is obviously unsatisfactory and confusing to the operator. In addition, it would be necessary to shift the lever 121 rearwardly for forward drive and forwardly for reverse drive, an obviously confusing situation.

In order to permit shifting of both motors in the same direction by the same movement of their control levers 73 and 121, a relatively simple mechanism is provided that consists of having the grooves 65 and 113 of the respective cams 61 and 109 face in opposite directions and the cranks 64 and 112 are 180° out of phase with each other so that the same direction of rotation of the respective shift rods 63 and 101 will achieve opposite axial movements of the shift cams 61 and 109. This is believed to be readily apparent from FIGS. 3 and 4. Hence, a relatively simple but highly effective mechanism is provided wherein both of the shift levers 73 and 121 may be moved in the same and forward directions so as to achieve forward drive and in the rearward direction so as to achieve reverse drive of each of the outboard motors 23 and 24.

Figure 8:
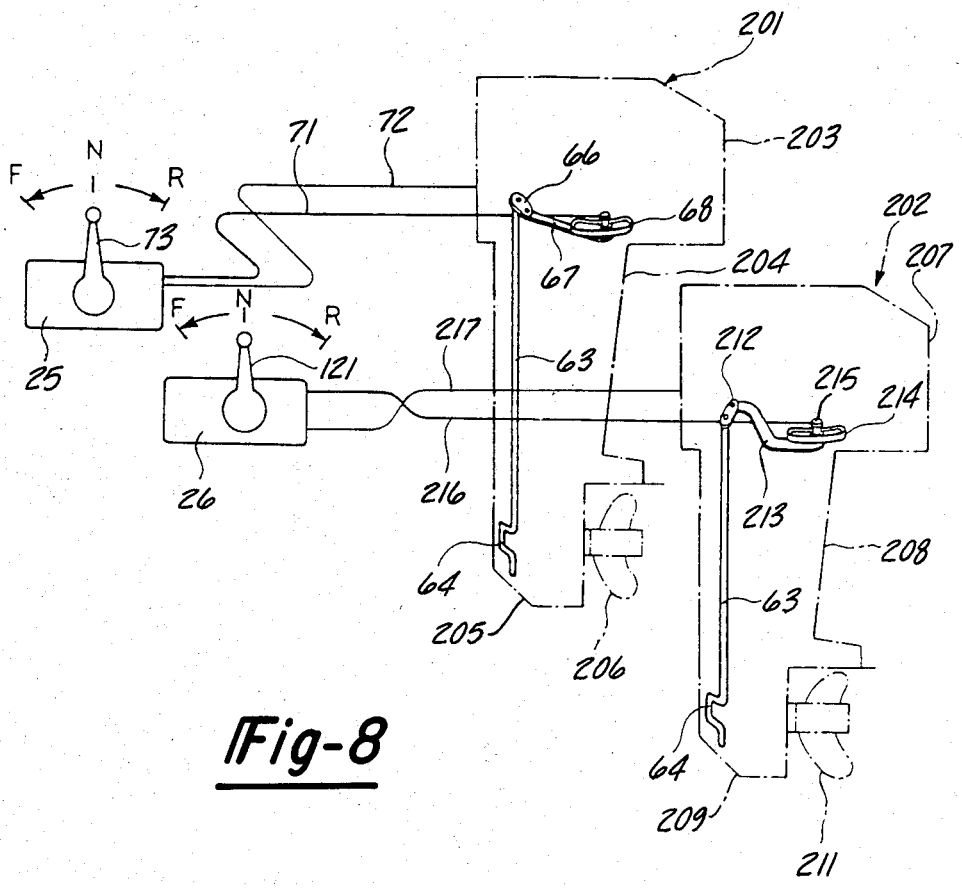
FIG. 8 is a partially schematic side elevational view, in part similar to FIG. 2, showing another embodiment of the invention.

Embodiment Of FIG. 8

A second embodiment of the invention is shown in FIG. 8. In conjunction with this embodiment, the mounting of the outboard drives and their association with the watercraft are the same as that shown in FIG. 1 and for that reason this figure has not been repeated. In this embodiment as best shown in FIG. 8, there are provided a pair of outboard motors 201 and 202 that are supported in side by side relationship on the transom of the associate watercraft and which are supported for steering movement about respective vertically extending steering axes and tilting and trim movement about generally horizontally extending axes in a known manner. The outboard motor 201 includes a power head 203 that contains an internal combustion engine and which has a surrounding protective cowling. The engine drives a drive shaft that is supported for rotation about a vertically extending axis and which extends through a drive shaft housing 204. The lower end of the drive shaft housing 204 terminates at a lower unit 205 in which a forward, neutral, reverse transmission is positioned for selectively driving a propeller 206 in a forward or reverse direction. In a similar manner, the outboard motor 202 includes a power head 207, a drive shaft housing 208, a lower unit 209 in which a forward, neutral transmission is positioned and which drives a propeller 211.

Figure 4:
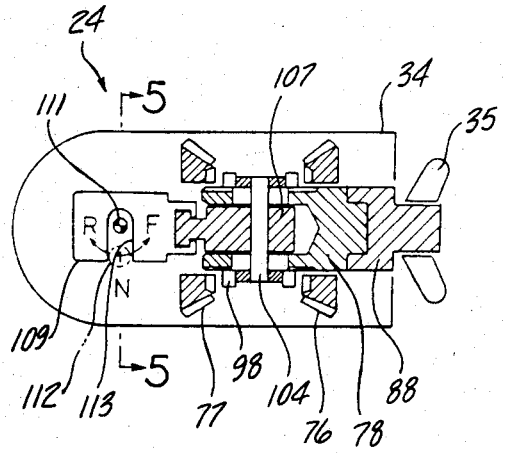
FIG. 4 is a cross-sectional view, in part similar to FIG. 3, showing a cross-sectional view of the transmission of the other of the outboard drives.
Figure 5:
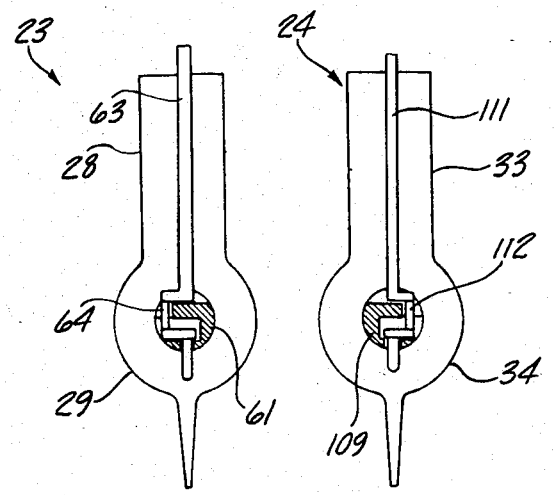
FIG. 5 is a cross-sectional view taken along the lines 5—5 of FIGS. 3 and 4 showing the relationship of the two outboard motors in their operative position on the watercraft.
Figure 6:
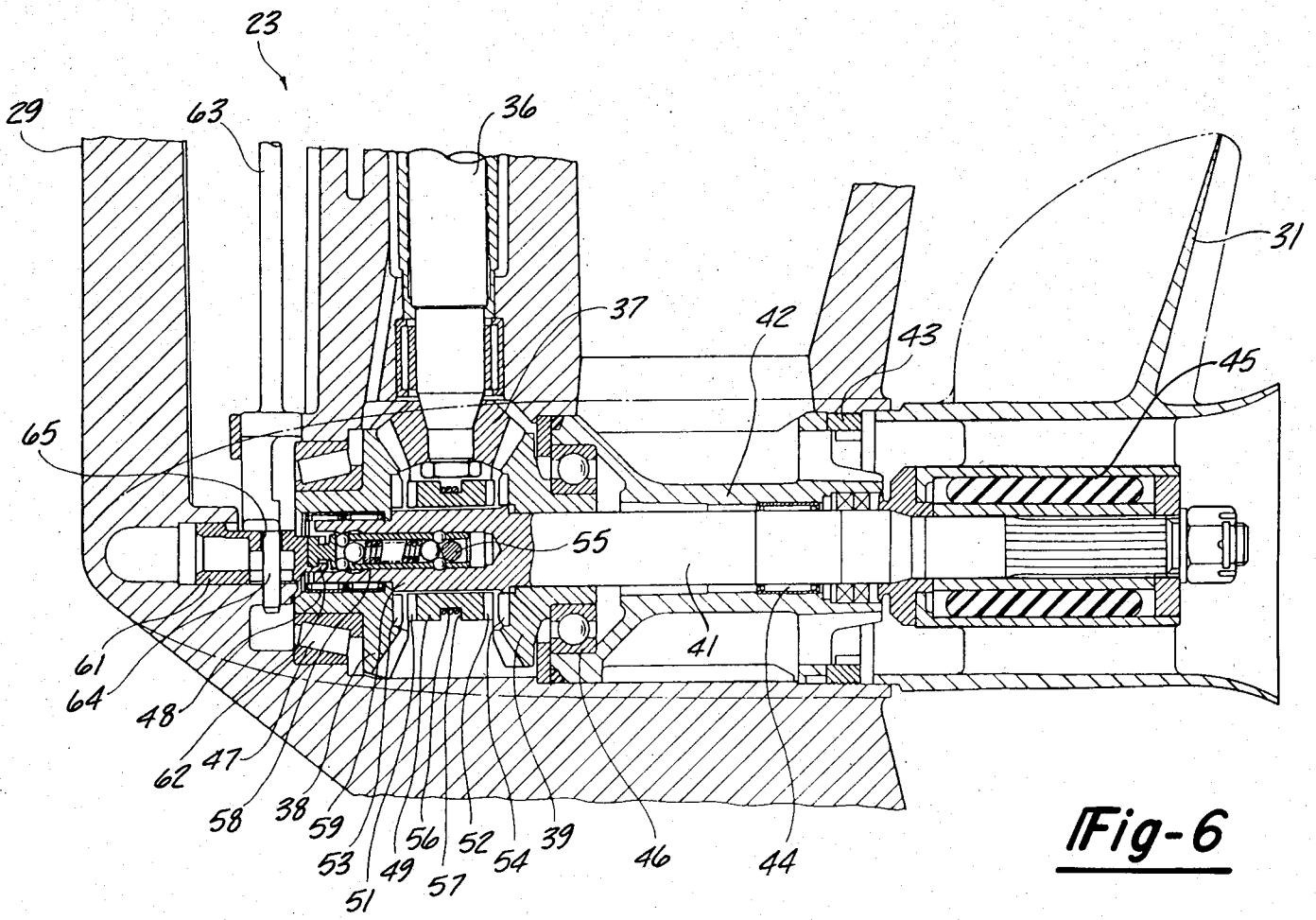
FIG. 6 is a longitudinal cross-sectional view taken through the transmission of one of the outboard drives in enlarged scale and a plane containing the axis of the propeller shaft and taken at 90° from the plane of FIG. 3.
Figure 7:
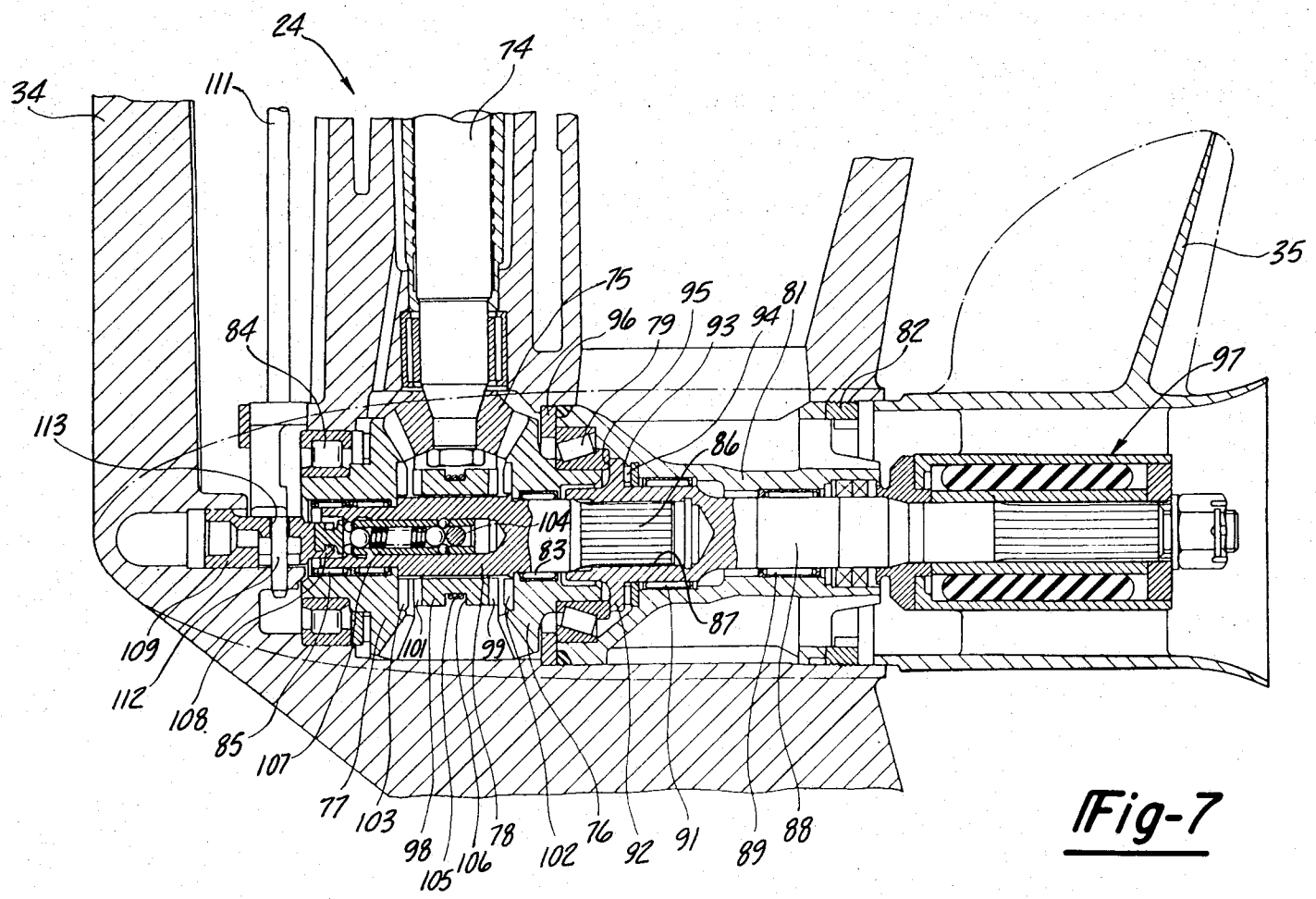
FIG. 7 is an enlarged cross-sectional view taken through the plane of the propeller shaft and at right angles to FIG. 4.

The transmission of the outboard motor 201 is the same in construction as that of the outboard motor 23 of the embodiment of FIGS. 1 through 7 and specifically has a construction of the type shown in FIGS. 3 and 6. The transmission of the outboard motor 202 is, in a like manner, the same as the transmission of the outboard motor 204 and has a construction as shown in FIGS. 4 and 7. In this embodiment, the shifting mechanism associated with the transmission of the outboard motor 201 is the same as the previously described embodiment and for that reason the control and its association with the shift rod have been identified by the same reference numerals and will not be described again in detail.

In the embodiment of FIGS. 1 through 7, the reverse motion of the shifting cam 109 associated with the outboard motor 24 employs a reversal in the relationship between the crank portions of the shifting rods and the shifting cam from that associated with the outboard motor 201. In this embodiment, however, the shifting cam and the crank and interrelationship between the two outboard motors is the same and, for that reason, the shifting rod has been identified by the same reference numeral (63) and the crank portion has been identified by the same reference numeral (64).

In this embodiment, the reversal of relative movement is achieved by providing a link 212 that is affixed to the upper end of the shifting rod 63 of the outboard motor 202 at 180° to the relationship of the link 66 with the shifting rod 63 of the outboard motor 201. An operating lever 213 is connected to the link 212 and carries a cam groove 214. An actuating cam member 215 is received in the cam groove 214 and is operated by means of a pair of wire control elements 216 and 217 that are connected to the control lever 121 of the control 26 for the outboard motor 202. Because of the reversal in the linkage system, forward motion of the control lever 121 will cause the operating rod 63 associated with the outboard motor 202 to rotate in the opposite sense from the previously described embodiment. That is, in the embodiment of FIGS. 1 through 7, forward motion of the respective control lever 73 and 121 accomplish rotation of the shift rods 63 and 111 in the same direction, however, there was an 180° out of phase relationship with the shifting cams of the two outboard motors. In this embodiment, when the control levers 73 and 121 are moved in the same direction, the shifting rods 63 associated with the respective outboard motors 201 and 202 will rotate in the opposite directions. As a result, the necessary shifting movement of the respective shifting cams associated with the transmissions of each motor will be in the proper direction so that the motors 201 and 202 will both be shifted into forward drive when the levers 73 and 121 are moved forwardly and into reverse drive when the levers 73 and 121 are moved in a rearward direction.

Embodiment Of FIGS. 9 Through 12

A third embodiment of the invention is illustrated in FIGS. 9 through 12. In this embodiment, like the embodiments of FIGS. 1 through 7 and FIG. 8, the outboard motors and their association with the watercraft is the same and this portion of the construction has not been illustrated nor is further description of it deemed to be necessary. In addition, in this embodiment, the remotely positioned shift controls are the same as the embodiment of FIGS. 1 through 7 as is the connection of those shift controls to the shift rod of that embodiment. Hence, only the transmission construction and the manner in which shifting is accomplished is illustrated in these figures.

Figure 10:
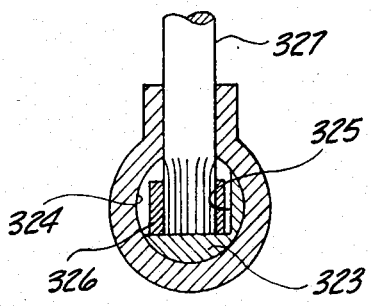
FIG. 10 is a cross-sectional view taken along the line 10—10 of FIG. 9.
Figure 9:
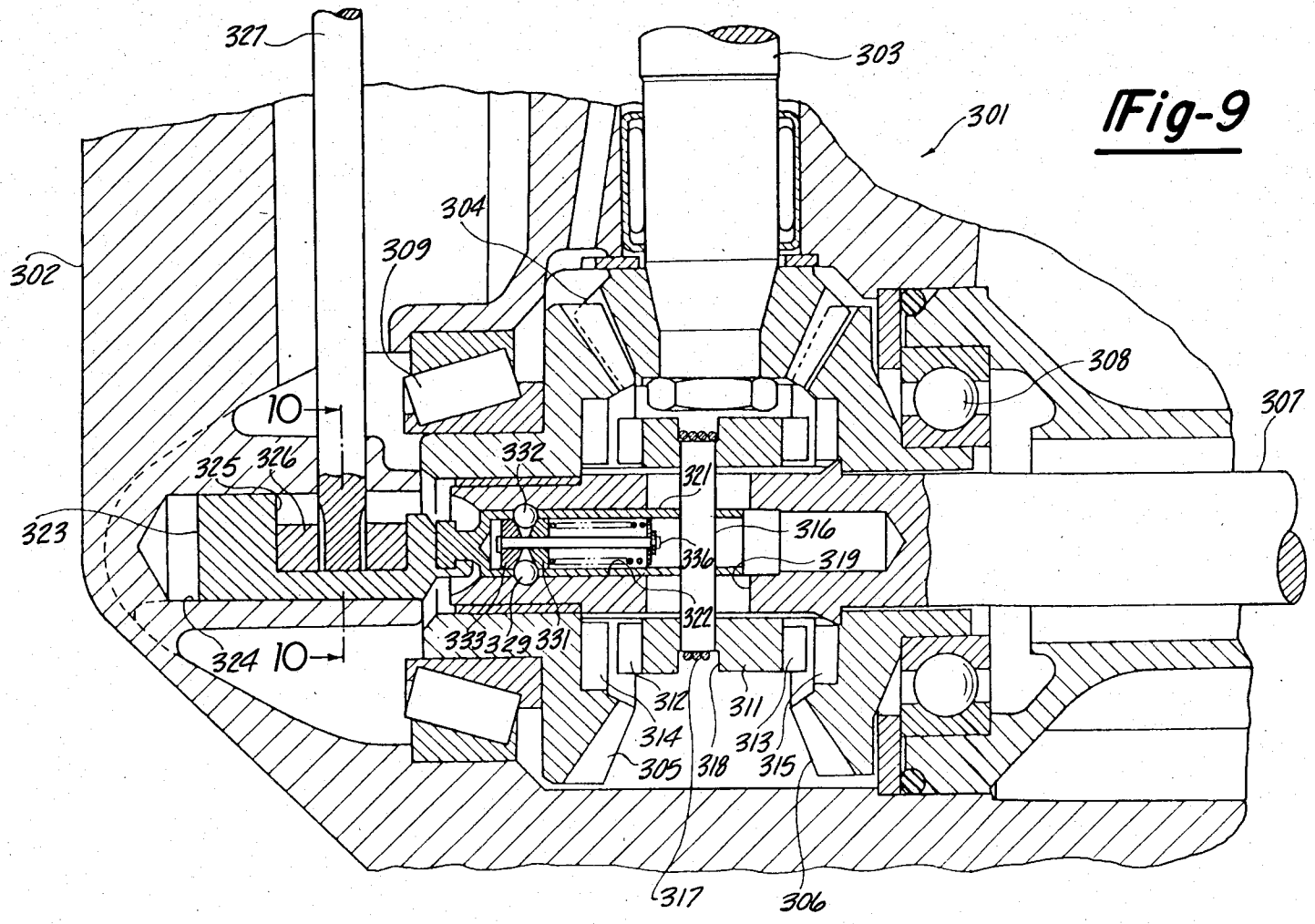
FIG. 9 is a cross-sectional view on an enlarged scale taken along the axis of the propeller shaft of the outboard drives of a third embodiment and is similar in part to FIGS. 6 and 7.
Figure 11:
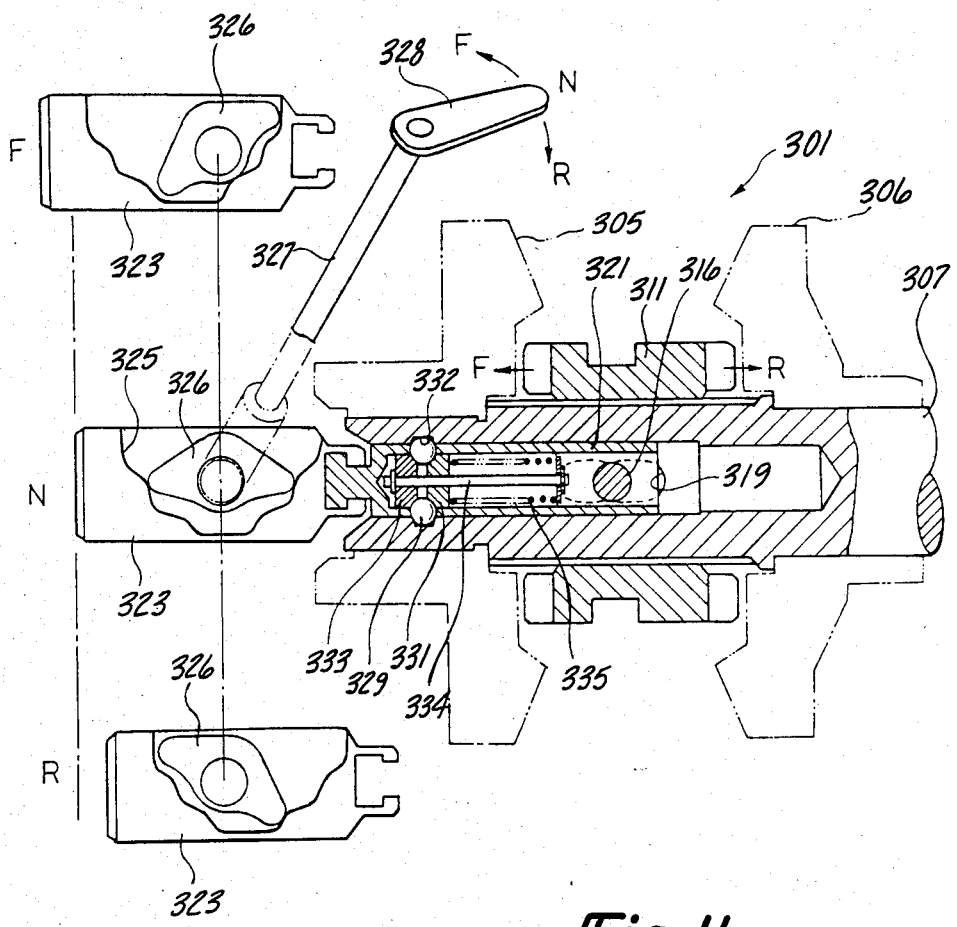
FIG. 11 is a partially schematic view showing the shift mechanism associated with one of the outboard drives of the third embodiment.

FIGS. 9 through 11 show transmission mechanism associated with one of the outboard motors, indicated generally by the reference numeral 301. The outboard motor 301 includes a lower unit 302 in which the lower end of an engine driven drive shaft 303 is journaled. A driving bevel gear 304 is affixed against rotation to the lower end of the drive shaft 303 and is in mesh with a pair of gears 305 and 306 that are positioned on diametrically opposite sides of the driving bevel gear 304. As a result, the driven bevel gears 305 and 306 will be rotated in oppolsite directions, as in the previously described embodiments.

The driven bevel gears 305 and 306 are rotatably journaled on a propeller shaft 307 which is connected to the propeller in a manner such as that previously described. The propeller shaft 307 is journaled at its rear end in a suitable manner and is journaled at its forward end by means including the gears 305 and 306. To this end, the gear 306 has a hub portion that is journaled by a roller bearing 308 that is carried in the lower unit. The bevel gear 305, which comprises the forward drive gear in this embodiment, is journaled by means of a thrust bearing 309 of the tapered roller type. The propeller shaft 307 is journaled within the hubs of the gears 305 and 306 by means of plain bearings. The gears 305 and 306 may be selectively coupled for rotation with the propeller shaft 307 by means of a dog clutch assembly including a dog clutching sleeve 311 which has a splined connection to the propeller shaft 307 so that the sleeve 311 will rotate with but be axially movable along the propeller shaft 307.

The dog clutching sleeve 311 has oppositely facing dog clutching jaws 312 and 313 that are adapted to coact with corresponding dog clutching jaws 314 and 315 formed on the gears 305 and 306, respectively. When the dog clutching teeth 312 and 314 are in engagement, the propeller shaft 307 will be driven in a forward direction. If the dog clutching jaws 313 and 315 are in engagement, the propeller shaft 307 will be driven in a reverse direction.

With the previously described embodiments, the mechanism for axially shifting the dog clutching sleeve 311 includes a pin 316 that is staked to the clutching sleeve 311 and retained by means of a torsional spring 317 that is received within a groove 318 of the sleeve 311. The pin 316 extends through elongated slots 319 formed in the propeller shaft 307 so as to accomplish axial movement while preventing rotation of the pin 316 relative to the propeller shaft 307.

A shifting sleeve 321 is slidably received within a bore 322 formed in the forward end of the propeller shaft 307. The pin 316 is affixed to the shifting sleeve 321. The forward end of the shifting sleeve 321 has tongue and groove connection with a shifting cam 323 that is slidably supported within a bore 324 formed in the lower unit casing. The tongue and groove connection between the shifting cam 323 and the shifting sleeve 321 is such that the members are coupled together for simultaneous axial movement while the sleeve 321 is permitted to rotate relative to the cam 323.

The shifting cam 323 is formed with a recess 325 in which a cam actuator 326 is positioned. The cam actuator 326 is splined to the lower end of a shift rod 327 that is journaled within the drive shaft housing. A shifting lever 328 is connected to the upper end of the shift rod 327. The shifting lever 328 may be operated directly by the operator or may be coupled to remotely positioned shift controls as with the embodiment of FIGS. 1 through 7. The shifting rod 327 is also torsionally resilient so as to act as a torsion bar.

A detent mechanism is provided for holding the dog clutching sleeve 311 in its neutral position. This detent mechanism requires a certain force to overcome it for shifting into either the forward or reverse directions and during the time when this movement is restrained, the shift rod 327 will wind up. Once the detent mechanism is released, the torsional force which has been stored in the shifting rod 327 will be released so as to snap the dog clutching teeth into engagement. This detent mechanism is of the type shown in copending Application Ser. No. 629,254, filed July 9, 1984, entitled "Shifting Apparatus For A Marine Proplulsion Device" and assigned to the same assignee of this application. The operation of the shift rod 327 as a torsional spring is described in full detail in that application.

The detent mechanism comprises a plurality of detent balls 328 that are received within openings 331 of the sleeve 321 and which are adapted to engage recesses 332 in the propeller shaft 307 when in the neutral position. The balls 329 are held in engagement with the recesses 332 by a pair of oppositely facing conical members 333 and 334 that are urged together by means of a coil compression spring 335 that encircles a shaft 336 which extends through the conical members 333 and 334. As a result of this construction and as described in the aforenoted copending Application Ser. No. 629,254, this detent mechanism offers the same force resisting release in either direction and hence shifting in either direction will be accomplished with the same force.

Figure 12:
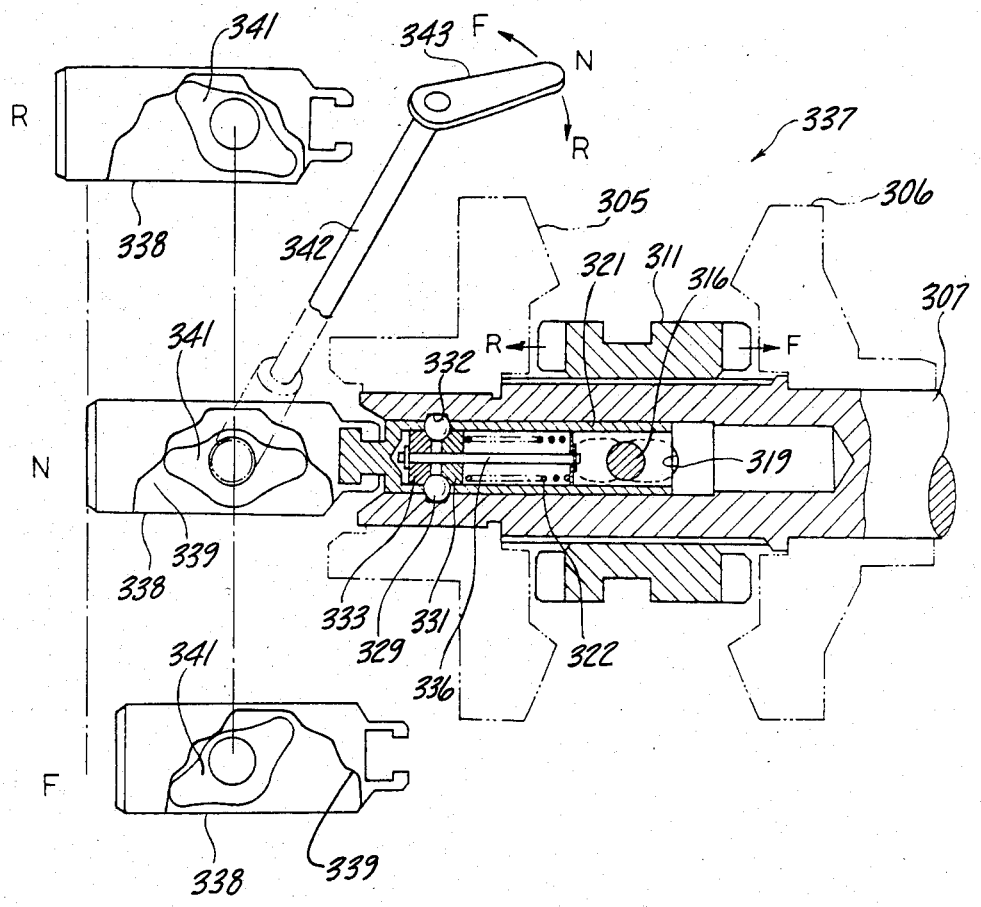
FIG. 12 is a view, in part similar to FIG. 11, and shows the other of the outboard drives of the third embodiment.

FIG. 12 shows the transmission arrangement associated with the other of the outboard motors 337. Basically, the transmission is the same as the transmission of the embodiment of FIG. 9. However, due to the desire to have counter-rotating propellers, in this motor, the gear 306 comprises the forward drive gear while the gear 305 comprises the reverse drive gear. For this reason, the thrust and roller bearings 308 and 309 are reversed but all other components are the same and hence have been identified by the same reference numerals and will not be described again.

For the reasons previously described, it is desirably to have dog clutching elements associated with each of the transmissions of the outboard motors be moved in opposite directions upon movement of the control levers in the same direction. To achieve this result in this embodiment, a shifting cam 338 is associated with the shifting sleeve 321 of the transmission of the outboard motor 337. This shifting cam 338 has a cam groove 339 which is positioned on the diametrically opposite side from the corresponding cam 325 of the outboard motor 301. In a like manner, an oppositely facing actuating cam 341 is affixed to the lower end of a shift rod 342. The shift rod 342 carries a lever 343 at its upper end and its rotation in the forward direction will achieve rearward movement of the shifting sleeve 331 and driving engagement between the forward drive gear 306 of the outboard motor 337 with the propeller shaft 307. Hence, this embodiment may be considered to be similar to the method in which the reverse movement is achieved in the embodiment of FIGS. 1 through 7.

Figure 13:
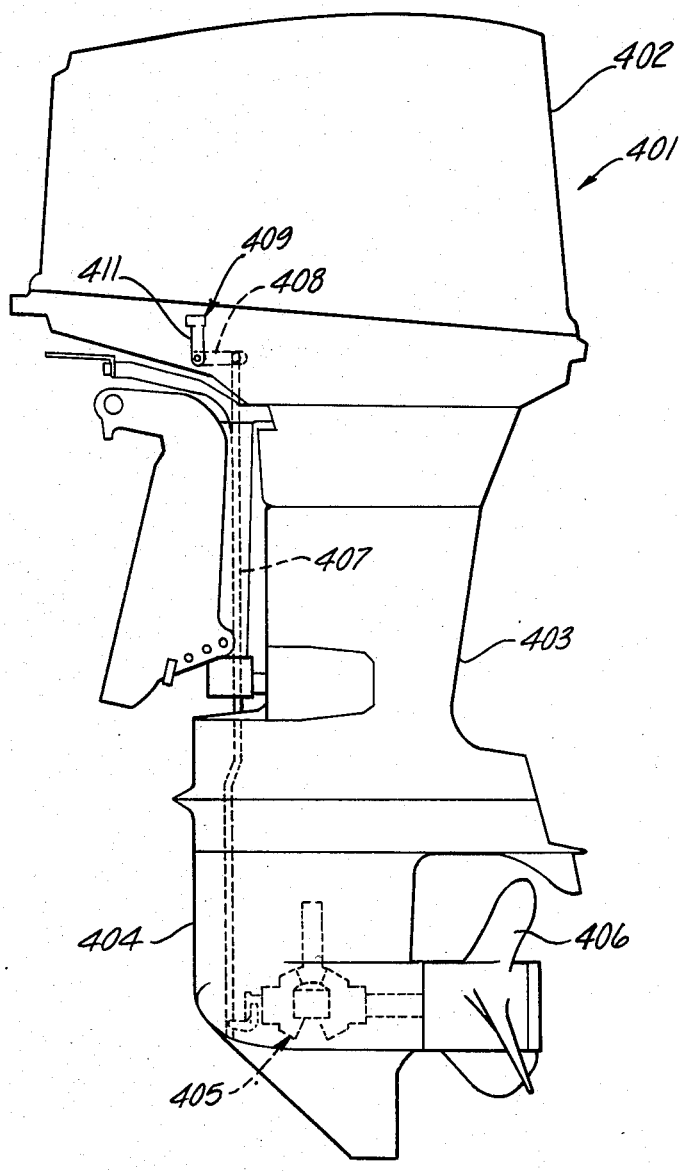
FIG. 13 is a side elevational view of an outboard motor constructed in accordance with yet another embodiment of the invention.
Figure 14:
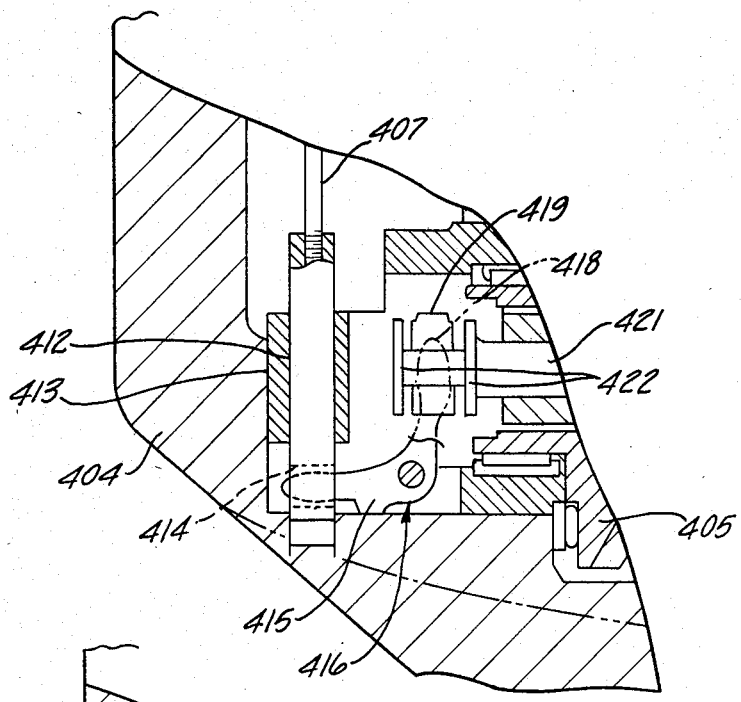
FIG. 14 is an enlarged cross-sectional view showing the shifting mechanis associated with one of the twin outboard drives of this embodiment.
Figure 15:
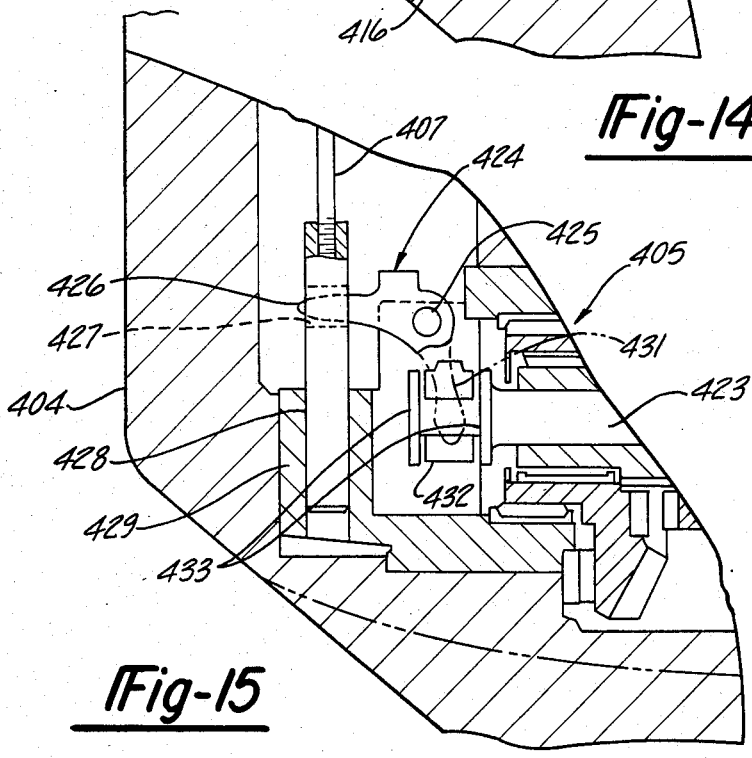
FIG. 15 is a cross-sectional view, in part similar to FIG. 14, showing the shifting mechanism associated with the other of the outboard drives.

Embodiment Of FIGS. 13 Through 15

In each of the embodiments thus far described, the shift rods have been rotatably supported within the drive shaft housing for actuating the shifting mechanism and transmission between its forward, neutral and reverse positions. It should be readily apparent that the invention is also capable of use in conjunction with engines wherein the shift rod moves axially for effecting the shifting rather than rotating. FIGS. 13 through 15 show such an embodiment.

An outboard motor constructed in accordance with this embodiment of the invention is identified generally by the reference numeral 401 and includes a power head 402, drive shaft housing 403 and lower unit 404. A forward, neutral, reverse transmission 405 is provided in the lower unit 404 for driving a propeller 406 in a forward, neutral or reverse condition. The transmission 405 has not been illustrated in any detail and may be the same as the transmission of any of the embodiment already illustrated.

The transmission 405 and specifically its shifting is controlled by means of a shift rod 407 that is supported for reciprocal movement in the drive shaft housing 403 and lower unit 404 in a suitable manner. The shifting rod 407 is connected, at its upper end, to one arm 408 of a bellcrank 409. The other bellcrank arm 411 is connected by means of flexible transmitters to the shift control mechanism in a manner as previously described.

Referring now primarily to FIGS. 14 and 15, the construction of the shift rod and its cooperation with the transmissions 405 will be described. FIG. 14 shows the arrangement associated with the normal, forwardly rotating outboard motor while FIG. 15 shows the construction associated with the counter-rotating outboard motor or the twin outboard drive.

Referring first to FIG. 14, the shift rod 407 is provided with a cylindrical member 412 at its lower end that is slidably supported within a bushing 413 in the lower unit 404. The clindrical member 412 is formed with a recess 414 that receives one arm 415 of a bellcrank, indicated generally by the reference numeral 416. The bellcrank 416 is pivotally supported in the lower unit 404 on a pivot pin 417 that extends transversely to the propeller shaft of the transmission 405. The bellcrank 416 is provided with a bifurcated arm 418 that is pivotally connected to a shifting sleeve 419 that is rotatably journaled on a shifting sleeve 421 between a pair of axially spaced shoulders 422. As with the previously described embodiments, axial movement of the shifting sleeve 421 effects forward, neutral or reverse gear selection. FIG. 14 illustrates the arrangement wherein the transmission 405 is in forward drive. In this position, the shifting rod 407 is at the lower end of its travel and the bellcrank 416 has been rotated in a counterclockwise direction so as to draw the shifting sleeve 421 to an extreme forwardmost position. To shift into neutral, the shifting rod 407 is raised so that the bellcrank 416 is rotated in a clockwise direction to axially move the shifting sleeve 421 rearwardly to its neutral position. Continued upward movement will effect reverse gear selection.

Referring now to FIG. 15, the shifting sleeve 423 of this transmission is operated so that it is in its extreme rearward position when the transmission 405 is in forward drive and in its extreme forward position when the transmission 405 is in its rearward drive for the reasons aforenoted with respect to twin outboard drives. In order to achieve these motions when the shifting rod 407 of this engine is operated in the same directions, a bellcrank, indicated generally by the reference numeral 424 is pivotally supported in the lower unit 404 on a pivot pin 425 that extends transversely to the propeller shaft and which is positioned above it. The bellcrank 424 has a first arm 426 that is received in a slot 427 formed in the cylindrical member 428 carried at the lower end of the shifting rod 408. The cylindrical member 428 is supported within a bushing 429 carried in the lower unit.

A bifurcated arm 431 of the bellcrank 424 is connected to a shifting sleeve 432 that is received between a pair of shoulders 433 on the shifting sleeve 423. As has been previously noted, FIG. 15 shows the transmission 405 of this engine in its forward position wherein the shifting sleeve 423 is moved rearwardly. To engage neutral, the shift rod 407 is raised to pivot the bellcrank 424 in a clockwise direction to move the shift sleeve 423 forwardly. Reverse gear is selected by continued upward movement.

It should be readily apparent that this embodiment effects opposite movement of the shifting sleeves 421 and 423 of the two outboard drives in response to movement of the shifting rods 407 in the same direction. Thus, the advantages of the previously described embodiments are also present in this embodiment.

From the foregoing description, it should be readily apparent that a number of embodiments of the invention have been illustrated and described and each of which will permit effective shifting of twin outboard motors into their same shifting condition (forward or reverse) by movement of the control levers in forward or reverse directions even though the outboard motors have counterrotating shafts. Although the invention is described in conjunction with outboard motors, it is believed that those skilled in the art will readily realize that the same principles can be employed in conjunction with the outboard drive unit of an inboard/outboard mechanism. In addition to the embodiments illustrated and described, various other changes and modifications may be made without departing from the spirit and scope of the invention, as defined by the appended claims.

We claim:

1. In a twin outboard drive for a watercraft comprising a first marine drive having a first transmission providing a forward, a neutral and a reverse drive ratio, a second marine drive having a second transmission providing a forward, a neutral and a reverse drive ratio, a first shift element movable between a forward, a neutral and a reverse position for operating said first transmission in those respective ratios, a second shift element movable between a forward, a neutral and a reverse position for operating said second transmission in those respective ratios, said first and said second shift elements being movable in like directions with the forward position of said first shift element corresponding to the reverse position of said second shift element and vice versa, a first shift control movable between a forward, a neutral and a reverse position, and a second shift control movable between a forward, a neutral and a reverse position, said first and said second shift controls being movable between their positions in like directions, the improvement comprising motion transmitting means operatively connecting said first shift control with said first shift element and said second shift control with said second shift element, said motion transmitting means being constructed and arranged for providing that the movement of said first and said second shift controls in the same direction from their forward position to their reverse position effect opposite movement of said shift elements.

2. In a twin outboard drive as set forth in claim 1 wherein each of the transmissions comprises a driving bevel gear and a pair of driven bevel gears meshingly engaged with said driving gear on opposite sides thereof for rotation of said driven gears in opposite directions upon rotation of the driving gear in a first direction.

3. In a twin outboard drive as set forth in claim 2 wherein the shift elements comprise dog clutches associated with the driven gears of the respective transmissions.

4. In a twin outboard drive as set forth in claim 3 wherein the driving gears of the respective transmission rotate in the same direction.

5. In a twin outboard drive as set forth in claim 1 wherein the motion transmitting means comprises a first crank element operatively associated with the first shift element for moving said first shift element upon rotation of said first crank element and a second crank element operatively associated with the second shift element for moving the second shift element upon rotation of the second crank element.

6. In a twin outboard drive as set forth in claim 5 wherein the crank elements rotate in the same direction upon movement of the shift control elements in the same direction.

7. In a twin outboard drive as set forth in claim 6 wherein the crank elements are disposed at 180° to each other when the shift elements are each in their neutral positions.

8. In a twin outboard drive as set forth in claim 6 wherein the crank elements comprise bellcranks and further including a reciprocally supported shift rod for rotating said bellcranks upon axial movement of said shift rod.

9. In a twin outboard drive as set forth in claim 8 wherein each of the transmissions comprises a driving bevel gear and a pair of driven bevel gears meshingly engaged with said driving gear on opposite sides thereof for rotation of said driven gears in opposite directions upon rotation of the driving gear in a first direction.

10. In a twin outboard drive as set forth in claim 9 wherein the shift elements comprise dog clutches associated with the driven gears of the respective transmissions.

11. In a twin outboard drive as set forth in claim 10 wherein the driving gears of the respective transmissions rotate in the same direction.

12. In a twin outboard drive as set forth in claim 7 wherein each of the transmissions comprises a driving bevel gear and a pair of driven bevel gears meshingly engaged with said driving gear on opposite sides thereof for rotation of said driven gears in opposite directions upon rotation of the driving gear in a first direction.

13. In a twin outboard drive as set forth in claim 12 wherein the shift elements comprise dog clutches associated with the driven gears of the respective transmissions.

14. In a twin outboard drive as set forth in claim 13 wherein the driving gears of the respective transmissions rotate in the same direction.

15. In a twin outboard drive as set forth in claim 5 wherein the crank elements rotate in opposite directions when the first and second shift control elements are moved in the same direction.

16. In a twin outboard drive as set forth in claim 15 wherein the crank elements are associated with the respective shift elements for moving the shift elements in opposite directions upon rotation of the crank elements in the same direction.

17. In a twin outboard drive as set forth in claim 16 wherein each of the transmissions comprises a driving bevel gear and a pair of driven bevel gears meshingly engaged with said driving gear on opposite sides thereof for rotation of said driven gears in opposite directions upon rotation of the driving gear in a first direction.

18. In a twin outboard drive as set forth in claim 17 wherein the shift elements comprise dog cluches associated with the driven gears of the respective transmissions.

19. In a twin outboard drive as set forth in claim 18 wherein the driving gears of the respective transmissions rotate in the same direction.

20. In a twin outboard drive as set forth in claim 1 wherein the motion transmitting means comprises a first cam operatively associated with the first shift control and a first follower operatively associated with the first shift element and a second cam operatively associated with the second shift control and a second follower associated with the second shift element, the rotation of said cams being effective to cause reciprocation of the respective followers.

21. In a twin outboard drive as set forth in claim 20 wherein the cams each have the same shape and the followers each have the same shape.

22. In a twin outboard drive as set forth in claim 21 wherein the relationship of the cams with the followers is such that rotation of the cams in the same direction causes reciprocation of the followers in opposite directions.

23. In a twin outboard drive as set forth in claim 22 wherein the followers comprise recesses formed in an element that is affixed for reciprocation with the respective shift element, said recesses being disposed on opposite sides.

24. In a twin outboard drive as set forth in claim 23 wherein each of the transmissions comprises a driving bevel gear and a pair of driven bevel gears meshingly engaged with said driving gear on opposite sides thereof for rotation of said driven gears in opposite directions upon rotation of the driving gear in a first direction.

25. In a twin outboard drive as set forth in claim 24 wherein the shift elements comprise dog clutches associated with the driven gears of the respective transmissions.

26. In a twin outboard drive as set forth in claim 25 wherein the driving gears of the respective transmission rotate in the same direction.

* * * * *

US004637802B1

REEXAMINATION CERTIFICATE (2082nd)

United States Patent [19] [11] B1 4,637,802

Taguchi et al. [45] Certificate Issued Sep. 7, 1993

[54] TWIN OUTBOARD DRIVE FOR WATERCRAFT

[75] Inventors: Michihiro Taguchi; Akihiro Onoue, both of Hamamatsu, Japan

[73] Assignee: Sanshin Kogyo Kabushiki Kaisha, Hamamatsu, Japan

Reexamination Request:
No. 90/002,488, Oct. 21, 1991

Reexamination Certificate for:

| | |
|---|---|
| Patent No.: | **4,637,802** |
| Issued: | **Jan. 20, 1987** |
| Appl. No.: | **823,593** |
| Filed: | **Jan. 29, 1986** |

[30] Foreign Application Priority Data

Jan. 31, 1985 [JP] Japan ..... 60-15413

[51] Int. Cl.[5] ..... B63H 21/28

[52] U.S. Cl. ..... 440/75; 440/79; 440/86; 74/378; 192/48.091

[58] Field of Search ..... 440/49, 79, 75, 80, 440/84, 900, 86; 74/378, 480 B, 491; 192/21, 48.91

[56] References Cited

U.S. PATENT DOCUMENTS

| | | | |
|---|---|---|---|
| 3,269,497 | 8/1966 | Bergstedt | 192/51 |
| 4,223,773 | 9/1980 | Croisant et al. | 192/48.91 |
| 4,302,196 | 11/1981 | Blanchard | 440/75 |
| 4,637,802 | 1/1987 | Taguchi et al. | 440/75 |

OTHER PUBLICATIONS

OMC Accessories Parts Catalog 1980 Part No. 173651.
Johnson Service Parts Catalog 1980 Part No. 390878.
Volvo Penta, Aquamatic Outboard Drive Instruction Book May 1971, Publ. No. 2515.

*Primary Examiner*—Ed Swinehart

[57] ABSTRACT

A twin outboard drive and more particularly to an improved transmission and shifting arrangement for such drives. The drives include forward, neutral and reverse transmissions of the bevel gear type and which provide counter-rotation of the respective associated propellers. One of the transmissions is shifted in one direction to shift from neutral to forward while the other transmission is shifted in the opposite direction to shift from neutral to forward. A pair of remote control shift levers are provided and a motion transmitting means connects the shift levers with the transmissions so that the transmissions are shifted in opposite directions when the shift levers are moved in the same direction. In some embodiments, this is accomplished by a crank and follower mechanism and in other embodiments, it is accomplished by a cam and follower arrangement.

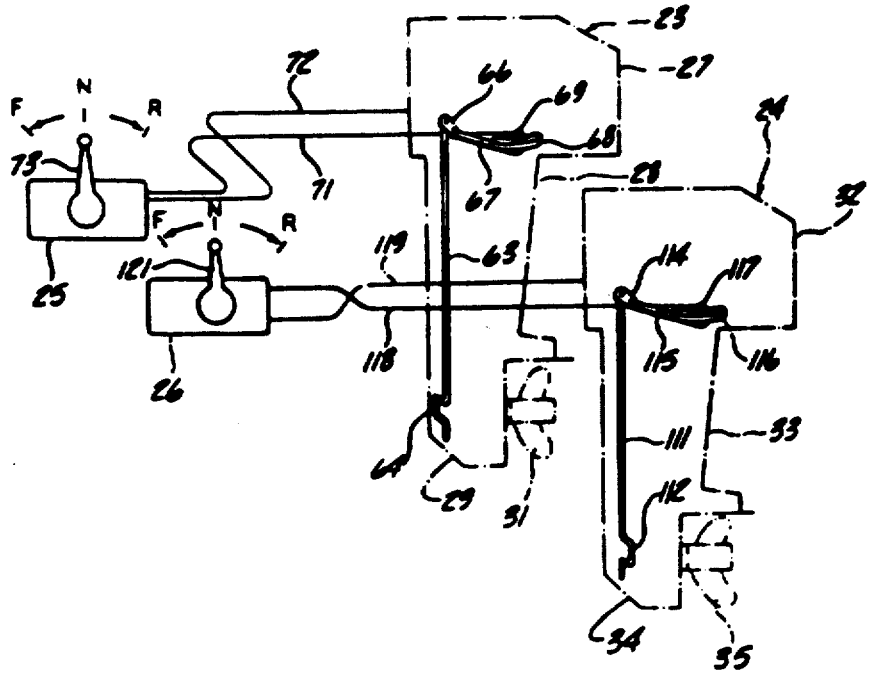

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-19 are cancelled.

Claim 20 is determined to be patentable as amended.

Claims 21-26, dependent on an amended claim, are determined to be patentable.

20. In a twin outboard drive [as set forth in claim 1 wherein the] *for a watercraft comprising a first marine drive having a first transmission providing a forward, a neutral and a reverse drive ratio, a second marine drive having a second transmission providing a forward, a neutral and a reverse drive ratio, a first shift element moveable between a reverse drive ratio, a first shift element moveable between a forward, a neutral and a reverse position for*

*operating said first transmission in those respective ratios, a second shift element moveable between a forward, a neutral and a reverse position for operating said second transmission in those respective ratios, said first and said second shift elements being moveable in like directions with the forward position of said first shift element corresponding to the reverse position of said second element and vice versa, a first shift control moveable between a forward, a neutral and a reverse position, and a second shift control moveable between a forward, a neutral and a reverse position, said first and said second shift controls being moveable between their positions in like directions, the improvement comprising motion transmitting means operatively connecting said first shift control with said first shift element and said second shift control with said second shift element, said motion transmitting means being constructed and arranged for providing that the movement of said first and said second shift controls in the same direction from their forward position to their reverse position effect opposite movement on said shift elements, said* motion transmitting means [comprises] *comprising* a first cam operatively associated with [the] *said* first shift control and a first follower operatively associated with [the] *said* first shift element and a second cam operatively associated with [the] *said* second shift control and a second follower associated with [the] *said* second shift element, the rotation of said cams being effective to cause reciprocation of the respective followers.

* * * * *